US007380362B2

(12) United States Patent
Curry et al.

(10) Patent No.: US 7,380,362 B2
(45) Date of Patent: Jun. 3, 2008

(54) FIREARM EXTRACTOR MECHANISM

(75) Inventors: Brett Curry, Chicopee, MA (US); Gary E. Zukowski, Indian Orchard, MA (US)

(73) Assignee: Smith & Wesson Corp., Springfield, MA (US)

( * ) Notice: Subject to any disclaimer, the term of this patent is extended or adjusted under 35 U.S.C. 154(b) by 125 days.

(21) Appl. No.: 11/316,661

(22) Filed: Dec. 22, 2005

(65) Prior Publication Data

US 2006/0185212 A1 Aug. 24, 2006

Related U.S. Application Data

(60) Provisional application No. 60/639,187, filed on Dec. 22, 2004, provisional application No. 60/638,594, filed on Dec. 22, 2004, provisional application No. 60/638,753, filed on Dec. 22, 2004, provisional application No. 60/638,593, filed on Dec. 22, 2004, provisional application No. 60/638,746, filed on Dec. 22, 2004, provisional application No. 60/638,592, filed on Dec. 22, 2004, provisional application No. 60/638,751, filed on Dec. 22, 2004, provisional application No. 60/638,752, filed on Dec. 22, 2004.

(51) Int. Cl.
*F41A 15/10* (2006.01)
*F41A 15/00* (2006.01)

(52) U.S. Cl. ..... 42/46; 42/25; 42/68

(58) Field of Classification Search ..... 42/25, 42/46, 68

See application file for complete search history.

(56) References Cited

U.S. PATENT DOCUMENTS 2,350,477 A * 6/1944 Rowley ..... 42/25
2,603,019 A * 7/1952 Louis ..... 42/25
2,870,562 A * 1/1959 Kimball ..... 42/25
2,929,163 A * 3/1960 Harvey ..... 42/25
2,984,924 A * 5/1961 Reed ..... 42/25
3,561,396 A * 2/1971 Luciani ..... 116/283
3,608,223 A * 9/1971 Dieckmann ..... 42/25
3,753,307 A * 8/1973 Usel ..... 42/25
4,011,678 A 3/1977 Brodbeck et al.
4,031,648 A 6/1977 Thomas
4,522,105 A 6/1985 Atchisson
4,539,889 A 9/1985 Glock
H87 H * 7/1986 Reynolds ..... 42/25
4,615,132 A * 10/1986 Smith ..... 42/25
H211 H * 2/1987 Vanderbeck ..... 42/17
4,825,744 A 5/1989 Glock (Continued)

*Primary Examiner*—Bret Hayes
(74) *Attorney, Agent, or Firm*—McCormick, Paulding & Huber LLP

(57) ABSTRACT

An extractor mechanism with improved reliability is provided having an extractor arm pivotally mounted within a pocket in a firearm slide. The extractor arm includes a body portion and a hook portion, the body portion being disposed within the pocket and the hook portion extending out of the pocket from an opening proximate to the breech face. The hook portion is biased toward the firearm's firing axis and includes a distal edge sized to engage a cartridge rim. The hook portion preferably has a height greater than the body portion and the portions are preferably connected by a curved portion. Two surfaces preferably meet at the distal edge of the hook portion, with the surface more proximal to the breech face being substantially parallel to the breech face and the surface more distant from the breech face, diverging from the breech face at an acute angle.

7 Claims, 5 Drawing Sheets

U.S. PATENT DOCUMENTS

| | | | | | |
|---|---|---|---|---|---|
| 4,893,546 | A | | 1/1990 | Glock | |
| 4,920,676 | A | * | 5/1990 | Peters | 42/25 |
| 4,967,724 | A | | 11/1990 | Senfter | |
| 5,012,604 | A | | 5/1991 | Rogers | |
| 5,018,292 | A | | 5/1991 | West | |
| 5,024,016 | A | * | 6/1991 | Smith | 42/25 |
| 5,024,139 | A | | 6/1991 | Knight, Jr. et al. | |
| 5,036,612 | A | | 8/1991 | Jennings | |
| 5,050,480 | A | | 9/1991 | Knight, Jr. et al. | |
| 5,050,481 | A | | 9/1991 | Knight, Jr. et al. | |
| 5,081,780 | A | | 1/1992 | Lishness et al. | |
| 5,086,578 | A | | 2/1992 | Lishness et al. | |
| 5,086,579 | A | | 2/1992 | Flatley et al. | |
| 5,088,222 | A | | 2/1992 | Larson | |
| 5,090,147 | A | | 2/1992 | Pastor | |
| 5,105,570 | A | | 4/1992 | Lishness et al. | |
| 5,115,588 | A | | 5/1992 | Bronsart et al. | |
| 5,119,634 | A | | 6/1992 | Berry et al. | |
| 5,133,142 | A | * | 7/1992 | Peters | 42/25 |
| 5,149,898 | A | | 9/1992 | Chesnut et al. | |
| 5,157,209 | A | | 10/1992 | Dunn | |
| 5,160,796 | A | | 11/1992 | Tuma et al. | |
| 5,164,534 | A | | 11/1992 | Royster | |
| 5,166,458 | A | | 11/1992 | Yoo | |
| 5,187,312 | A | | 2/1993 | Osborne | |
| 5,195,226 | A | | 3/1993 | Bornancini | |
| 5,216,191 | A | | 6/1993 | Fox | |
| 5,216,195 | A | | 6/1993 | Tuma | |
| 5,225,612 | A | | 7/1993 | Bernkrant | |
| 5,235,770 | A | | 8/1993 | Simon et al. | |
| 5,241,769 | A | | 9/1993 | Von Muller | |
| 5,247,757 | A | | 9/1993 | Deeb | |
| 5,251,394 | A | | 10/1993 | Bornancini | |
| 5,267,407 | A | | 12/1993 | Bornancini | |
| 5,272,957 | A | | 12/1993 | Chesnut et al. | |
| 5,299,374 | A | | 4/1994 | Mathys | |
| 5,303,494 | A | | 4/1994 | Tuma et al. | |
| 5,327,810 | A | | 7/1994 | Sandusky et al. | |
| 5,349,939 | A | | 9/1994 | Perrone | |
| 5,355,768 | A | | 10/1994 | Felk | |
| 5,373,775 | A | | 12/1994 | Findlay, Sr. et al. | |
| 5,386,659 | A | | 2/1995 | Vaid et al. | |
| 5,388,362 | A | | 2/1995 | Melcher | |
| 5,400,537 | A | | 3/1995 | Meller et al. | |
| 5,410,831 | A | * | 5/1995 | Felk | 42/25 |
| 5,412,894 | A | | 5/1995 | Moon | |
| 5,417,001 | A | | 5/1995 | Rousseau | |
| 5,426,881 | A | | 6/1995 | Ruger | |
| 5,438,784 | A | | 8/1995 | Lenkarski et al. | |
| 5,448,939 | A | | 9/1995 | Findlay, Sr. et al. | |
| 5,487,233 | A | | 1/1996 | Jewell | |
| 5,493,806 | A | | 2/1996 | Langevin et al. | |
| 5,502,914 | A | | 4/1996 | Moon | |
| 5,517,896 | A | | 5/1996 | Perrine | |
| 5,517,897 | A | * | 5/1996 | Perrine | 89/189 |
| 5,548,914 | A | | 8/1996 | Anderson | |
| 5,570,527 | A | | 11/1996 | Felicci | |
| 5,581,927 | A | | 12/1996 | Meller | |
| 5,604,326 | A | | 2/1997 | Lescure | |
| 5,606,825 | A | | 3/1997 | Olsen | |
| 5,608,981 | A | * | 3/1997 | Canaday | 42/25 |
| 5,615,507 | A | | 4/1997 | French | |
| 5,623,114 | A | | 4/1997 | Soper | |
| 5,625,971 | A | | 5/1997 | Tuma et al. | |
| 5,634,456 | A | | 6/1997 | Perrone | |
| 5,635,664 | A | | 6/1997 | Pons et al. | |
| 5,640,794 | A | | 6/1997 | Gardner et al. | |
| 5,655,326 | A | | 8/1997 | Levavi et al. | |
| 5,669,169 | A | | 9/1997 | Schmitter et al. | |
| 5,678,340 | A | * | 10/1997 | Moon | 42/25 |
| 5,680,722 | A | | 10/1997 | French et al. | |
| 5,697,178 | A | | 12/1997 | Haskell | |
| 5,701,698 | A | | 12/1997 | Wesp et al. | |
| 5,709,046 | A | | 1/1998 | Canaday | |
| 5,711,286 | A | | 1/1998 | Petrosyan et al. | |
| 5,713,150 | A | | 2/1998 | Ealovega | |
| 5,717,156 | A | | 2/1998 | Lenkarski | |
| 5,718,074 | A | | 2/1998 | Keeney | |
| 5,736,667 | A | | 4/1998 | Munostes et al. | |
| 5,760,328 | A | | 6/1998 | Robbins | |
| 5,770,814 | A | | 6/1998 | Ealovega | |
| 5,778,585 | A | | 7/1998 | Sigg | |
| 5,794,373 | A | * | 8/1998 | Moon | 42/25 |
| 5,797,206 | A | | 8/1998 | Vitorino | |
| 5,806,225 | A | | 9/1998 | Gardner et al. | |
| 5,815,973 | A | | 10/1998 | Hochstrate | |
| 5,826,362 | A | | 10/1998 | Lyons | |
| 5,834,678 | A | | 11/1998 | Kalb | |
| 5,852,891 | A | | 12/1998 | Onishi et al. | |
| 5,857,280 | A | | 1/1999 | Jewell | |
| 5,906,066 | A | | 5/1999 | Felk | |
| 5,913,261 | A | | 6/1999 | Guhring et al. | |
| 5,974,717 | A | | 11/1999 | Brooks | |
| 5,987,796 | A | | 11/1999 | Brooks | |
| 6,000,162 | A | | 12/1999 | Hochstrate | |
| 6,070,512 | A | | 6/2000 | Rohrbaugh | |
| 6,125,735 | A | | 10/2000 | Guhring | |
| 6,131,324 | A | | 10/2000 | Jewell | |
| 6,164,001 | A | | 12/2000 | Lee | |
| 6,205,694 | B1 | | 3/2001 | Davis, Sr. | |
| 6,240,669 | B1 | | 6/2001 | Spaniel et al. | |
| 6,253,479 | B1 | | 7/2001 | Fuchs et al. | |
| 6,256,918 | B1 | | 7/2001 | Szabo | |
| 6,256,920 | B1 | | 7/2001 | Olson | |
| 6,263,607 | B1 | | 7/2001 | Fuchs et al. | |
| 6,266,909 | B1 | | 7/2001 | Fuchs et al. | |
| 6,272,783 | B1 | | 8/2001 | Dumortier et al. | |
| 6,289,619 | B1 | | 9/2001 | Fuchs et al. | |
| 6,293,039 | B1 | | 9/2001 | Fuchs | |
| 6,341,442 | B1 | | 1/2002 | Szabo et al. | |
| 6,354,032 | B1 | | 3/2002 | Viani | |
| 6,367,186 | B1 | | 4/2002 | Gibala | |
| 6,381,892 | B1 | | 5/2002 | Szabo et al. | |
| 6,382,200 | B1 | | 5/2002 | Levkov | |
| 6,405,631 | B1 | | 6/2002 | Milek | |
| 6,412,206 | B1 | | 7/2002 | Strayer | |
| 6,415,702 | B1 | | 7/2002 | Szabo et al. | |
| 6,425,199 | B1 | | 7/2002 | Vaid et al. | |
| 6,513,273 | B2 | | 2/2003 | da Silveira | |
| 6,519,887 | B1 | | 2/2003 | Allen et al. | |
| 6,526,684 | B1 | | 3/2003 | Hickerson | |
| 6,539,658 | B1 | | 4/2003 | Hubert et al. | |
| 6,543,169 | B2 | | 4/2003 | Bero | |
| 6,553,706 | B1 | | 4/2003 | Gancarz et al. | |
| 6,557,288 | B2 | | 5/2003 | Szabo | |
| 6,560,909 | B2 | | 5/2003 | Cominolli | |
| 6,588,136 | B2 | | 7/2003 | Baker et al. | |
| 6,601,331 | B2 | | 8/2003 | Salvitti | |
| 6,615,527 | B1 | | 9/2003 | Martin | |
| 6,640,478 | B2 | | 11/2003 | Johansson | |
| 6,643,968 | B2 | | 11/2003 | Glock | |
| 6,655,066 | B2 | | 12/2003 | Fluhr | |
| 6,665,973 | B1 | | 12/2003 | Peev | |
| 6,688,210 | B2 | | 2/2004 | Bubits | |
| 6,705,036 | B2 | | 3/2004 | Orr | |
| 6,711,842 | B1 | | 3/2004 | Chapman | |
| 6,718,680 | B2 | | 4/2004 | Roca et al. | |
| 6,732,464 | B2 | | 5/2004 | Kurvinen | |
| 6,732,465 | B2 | * | 5/2004 | Strayer | 42/69.03 |
| 6,735,897 | B1 | | 5/2004 | Schmitter et al. | |
| 6,769,208 | B2 | | 8/2004 | Beretta | |
| 6,789,342 | B2 | | 9/2004 | Wonisch et al. | |
| 6,851,212 | B2 | * | 2/2005 | Szabo | 42/46 |
| 6,966,137 | B2 | * | 11/2005 | Gussalli Beretta | 42/46 |

2004/0055198 A1* 3/2004 Gussalli ..... 42/46
2004/0159032 A1* 8/2004 Szabo ..... 42/46
2005/0115127 A1* 6/2005 Szabo ..... 42/46
2006/0143966 A1* 7/2006 Reynolds et al. ..... 42/46

* cited by examiner

FIREARM EXTRACTOR MECHANISM

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

FIELD OF THE INVENTION

The present invention relates generally to semiautomatic pistols or handguns and, more particularly, to an extractor mechanism for a handgun.

BACKGROUND OF THE INVENTION

Various types of extractor mechanisms for removing cartridges or casings from the firing chambers of semiautomatic pistols or handguns exist. One type of extractor mechanism comprises a substantially flat elongated spring steel member that is mounted to the slide of the handgun. A hook or claw is positioned on the forward end of the member to engage the rim of the cartridge casing as the casing is contained within the firing chamber of the handgun. When engaged, the hook positions the rim of the casing in the space (known as the headspace) between the hook and a breech face of the slide. Upon operation of the handgun, the firing pin projects through the breech face to contact the primer of the casing and fire the cartridge.

Upon firing the cartridge (or manually drawing the slide from its forward (battery) position to its rearward (retired) position), the hook of the extractor mechanism removes the cartridge or spent casing from the chamber and ejects it through an ejection port, thereby throwing it clear of the handgun.

One operable feature of the extractor mechanism is the extractor arm from which the hook depends to extend into the firing chamber to grasp the rim of the cartridge and eject it as the slide moves in the rearward direction. The axial distance between the engaging surface of the hook and the breech face, which forms the rear wall of the firing chamber and supports the cartridge in the firing position, ensures the proper ejection of a spent cartridge. When the handgun is fired, the hook travels in the rearward direction with the slide and engages the cartridge rim to pull the cartridge from the rear of the barrel. As the cartridge is pulled over a shoulder protruding from the frame assembly, the cartridge is forced out through the ejection port in the slide and thrown clear from the handgun.

Occasionally, however, such extractor mechanisms fail to properly eject the spent cartridge, resulting in a firearm jam or other malfunction that is potentially dangerous to clear and can delay further use of the firearm in time critical situations (e.g., military or law enforcement use). Accordingly, there is a need for an extractor mechanism for a handgun that enhances consistent, reliable operation during the cycling of the slide.

SUMMARY OF THE INVENTION

In view of the foregoing, it is an object of the present invention to provide an extractor mechanism for a semiautomatic firearm, with an extractor arm having a body portion and a hook portion. The extractor arm is preferably pivotally mounted within a pocket of a firearm slide with the hook portion extending out of the pocket from an opening proximate to the slide's breech face and biased toward the firearm's firing access. A distal edge of the hook portion is sized to engage a cartridge rim.

In one embodiment the operation of the extractor mechanism is enhanced by providing a hook portion with a height in a plane perpendicular to the firing axis that exceeds the height of the body portion in a plane parallel to the firing axis.

In another advantageous embodiment a curved transition portion connects the hook and body portions.

In an additional embodiment, a first and second surface meet at the distal edge, the first surface being more proximate to the breech face than the second surface. The first surface is arranged in a plane substantially parallel to the breech face, whereas the second surface is a plane that diverges acutely from the breech face.

An advantage provided by various embodiments of the present invention is that the reliability of the ejection function of a handgun is improved. In particular, the downward-extending portion of the hook facilitates the grasping of a cartridge rim as the slide travels rearward during cycling.

These and other advantages and features of the present invention will be clear from the drawings and detailed description.

DETAILED DESCRIPTION

Figure 1:
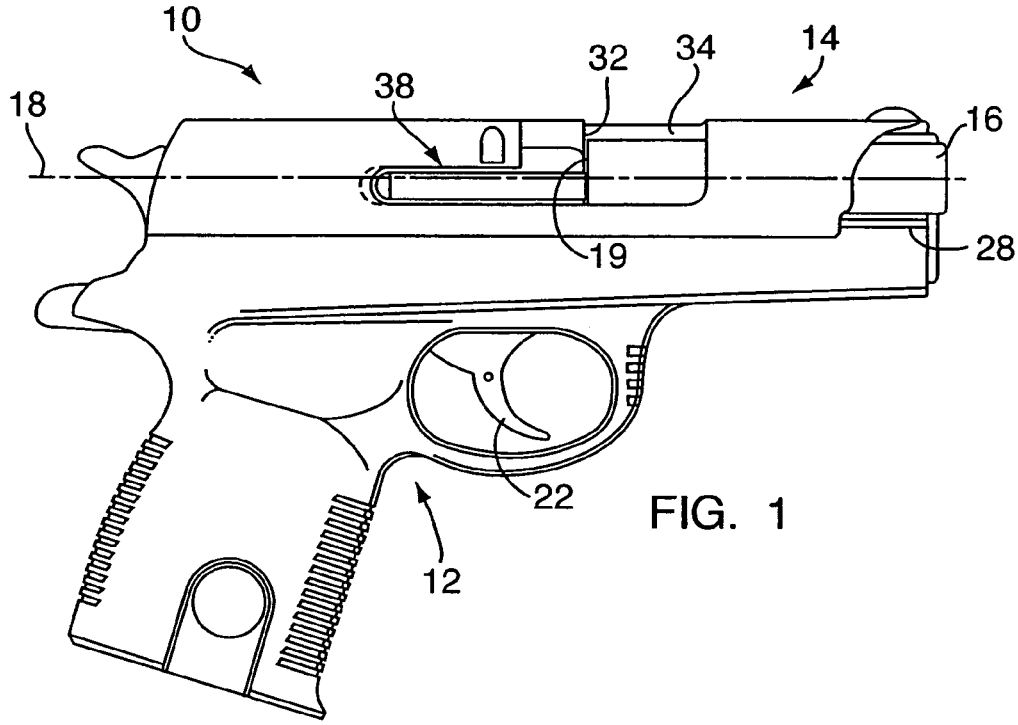
FIG. 1 is a simplified schematic view of a pistol shown with an extractor mechanism of the present invention.
Figure 2:
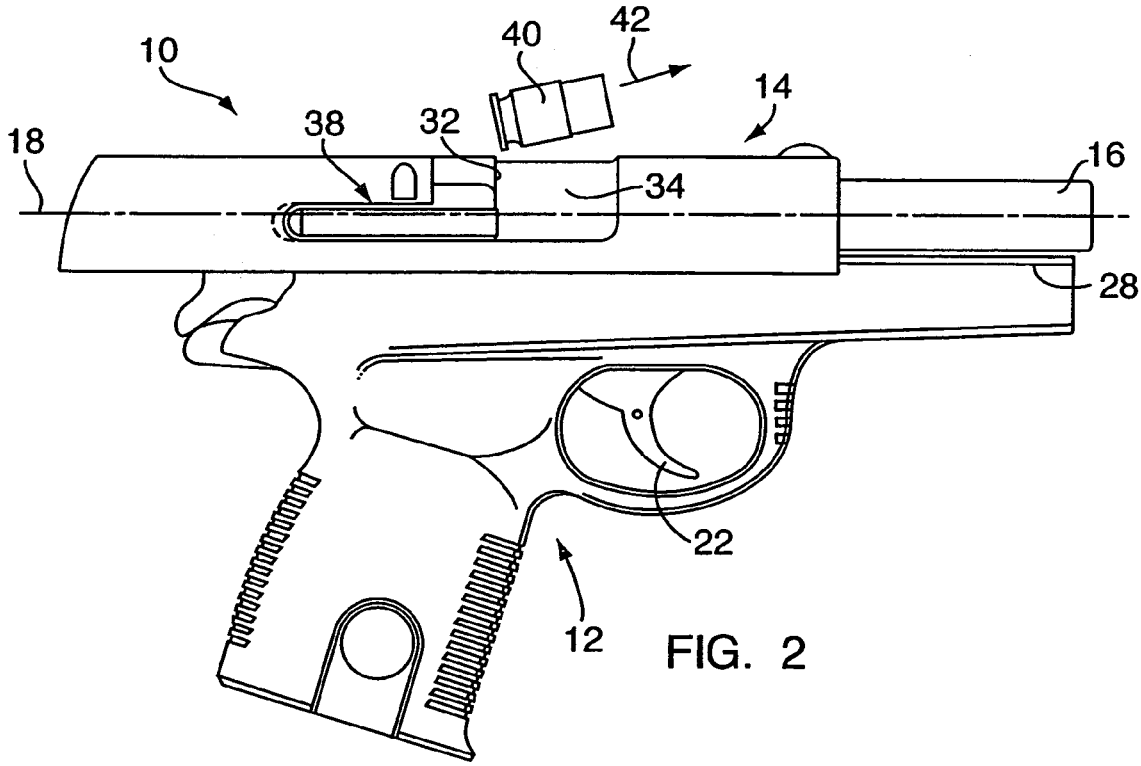
FIG. 2 is a simplified schematic view of the pistol of FIG. 1 shown with the slide moved to a rearward position on the pistol frame.

Referring to FIGS. 1 and 2, a semiautomatic pistol or handgun is shown generally at 10 and is hereinafter referred to as "handgun 10." The handgun 10 comprises a frame assembly 12, a slide 14, a barrel 16, and a firing mechanism. The frame assembly 12 is fabricated of a high-impact polymer material, metal, or a combination of polymer and metal. The barrel 16 is disposed in the forward end of the slide 14, is cooperatively linked therewith, and, together with the slide 14, defines a longitudinal firing axis 18. A rearward end 19 of the barrel 16 is adapted for receiving an ammunition cartridge. A trigger 22 is pivotally mounted to the frame assembly 12 to actuate the firing mechanism and fire the handgun 10. The firing mechanism acts on a firing pin that is generally centered on the firing axis 18 and biased in a rearward direction by a firing spring, in the handgun shown. Other types of firing mechanisms are employed in semiautomatic handguns, as is well known to those skilled in the art. The present invention is not limited to a particular type of semiautomatic firing mechanism.

The slide 14 is fitted to opposingly-positioned rails 28 of the frame assembly 12 to effect the reciprocal movement of the slide 14 along the longitudinal firing axis 18. The rails 28 extend along the underside of the slide 14 in the longitudinal direction and are cooperative with the frame assembly 12 to allow the cycling of the slide 14 between forward (battery) and rearward (retired) positions. The slide 14 further includes a breech face 32 and an extractor port 34. The breech face 32 is engagable with the rearward end 19 of the barrel 16 to form a firing chamber when the slide 14 is disposed forwardly on the frame assembly 12. An ejector mechanism, generally 38, provides for the ejection of a cartridge casing 40 in a direction indicated by an arrow 42 upon firing of the handgun 10 or manual cycling of the slide 14.

For the present type of firearm, the cooperation of the frame assembly 12, the slide 14, and the firing mechanism during the loading, firing, and ejecting of a cartridge casing 40 can be understood by referring to U.S. Pat. No. 5,086,579 entitled "DECOCKING MECHANISM FOR A SEMI-AUTOMATIC FIREARM"; U.S. Pat. No. 5,386,659 entitled "FIRE CONTROL MECHANISM FOR SEMIAUTOMATIC PISTOLS"; and U.S. Pat. No. 5,406,731 entitled "HANDGUN OF IMPROVED ERGONOMIC CONSTRUCTION", all of which are owned by the Assignee and are incorporated by reference herein.

Figure 3:
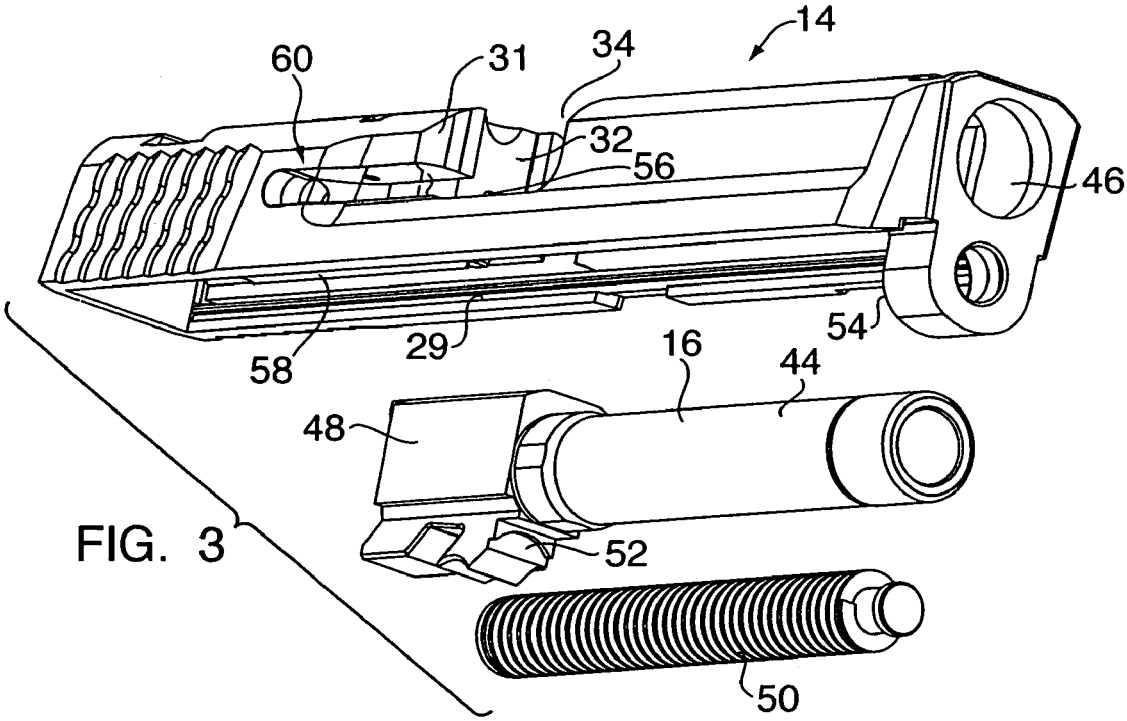
FIG. 3 is a simplified schematic exploded perspective view of the assembly of the slide, the barrel, and the recoil spring.

Referring now to FIG. 3, the slide 14, in the semiautomatic handgun shown, is an elongated box-like structure having a rearward end that is enclosed to house the firing pin and an open forward end in which the barrel 16 is mounted. The rails 28 are engaged by surfaces 29 extending from the forward end of the slide 14 to the rearward end of the slide 14. The barrel 16 includes a tubular portion 44 that is receivable through an aperture 46 at the forward end of the slide 14 and a rear portion 48 that, when the barrel 16 is positioned in the slide 14, closes the extractor port 34. The slide 14 and the barrel 16 are linkably connected such that when the slide 14 is cycled in the rearward direction, the barrel 16 unlinks therefrom. A recoil spring 50 is operatively engaged with the barrel 16. The operative engagement of the recoil spring 50 with the barrel 16 is effected by the engagement of one end of the recoil spring 50 with a surface 52 on the barrel 16 and by the engagement of the other end of the recoil spring 50 with a surface 54 on the slide 14.

The forward-most portion of the dosed rearward end of the slide 14 includes a breech block 31. The forward-most surface of the breech block 31 defines the breech face 32. The breech face 32 includes an opening 56 through which the forward end of the firing pin is received to strike the cartridge and fire the handgun. The undersurface of the dosed rearward end of the slide 14 also includes a pickup rail 58 that, upon operation of the handgun, strips cartridges from a magazine and urges the cartridges into a firing position.

The ejector mechanism (shown at 38 in FIGS. 1 and 2) includes an extractor mechanism/means 60 mounted on an inner surface of the slide 14 proximate the breech face 32 and a shoulder (not shown) disposed on the frame assembly. The extractor mechanism 60 is laterally displaced from the firing axis and is positioned so as to be horizontal relative to the firing axis. Upon cycling of the slide, the extractor mechanism 60 cooperates with the shoulder to eject cartridges or spent cartridge casings. When the slide 14 is moved to a retired position, the firing chamber is exposed through the extractor port 34, and the shoulder acts with the extractor mechanism 60 to engage the casing and eject it from the firing chamber through the extractor port 34.

Figure 4:
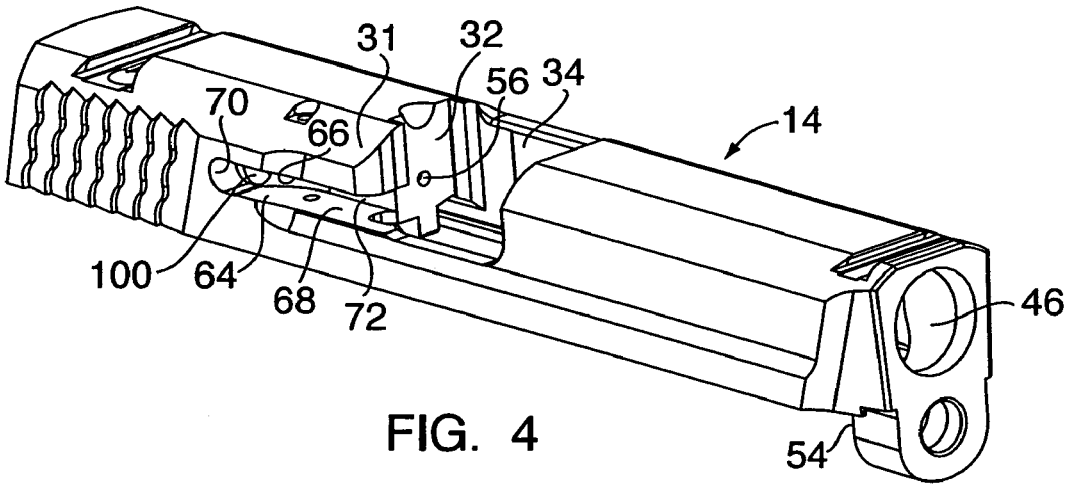
FIG. 4 is a simplified schematic perspective view of the slide showing the breech face and the pocket in which the extractor mechanism is housed.
Figure 5:
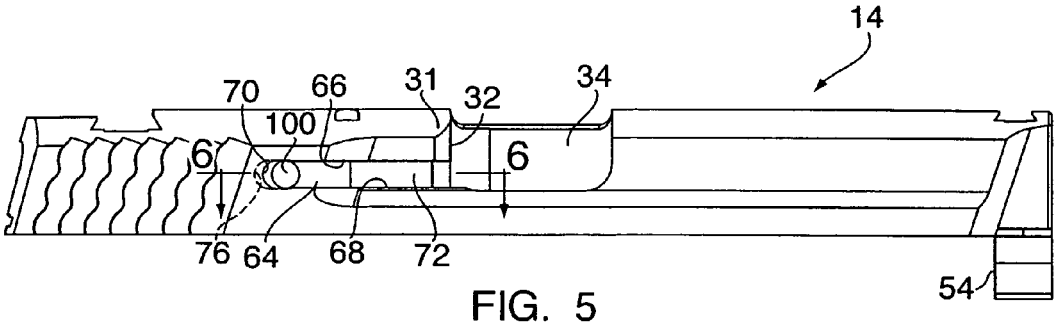
FIG. 5 is a simplified schematic side elevational view of the slide showing the pocket in which the extractor mechanism is housed.
Figure 6:
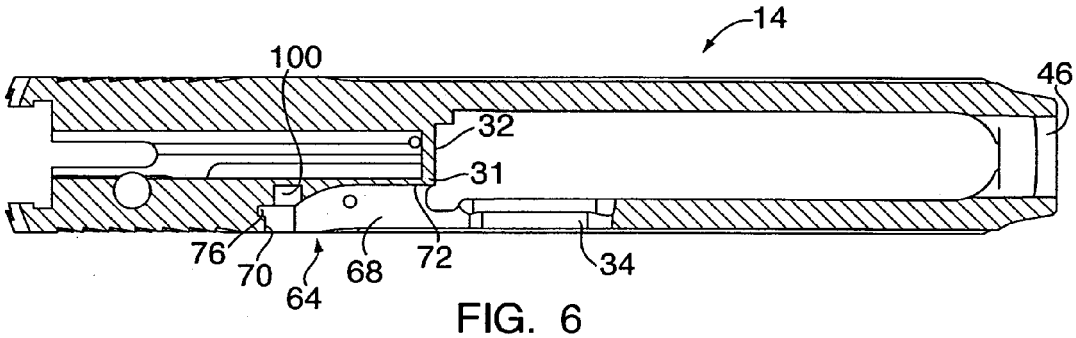
FIG. 6 is a simplified schematic plan view of the pocket in which the extractor mechanism is housed.

Referring now to FIGS. 4-6, a cavity or pocket 64 is formed in a side wall of the slide 14 to accommodate the extractor arm 80. The pocket 64 includes an upper pocket surface 66, a lower pocket surface 68, and a contoured end 70. The upper pocket surface 66 and the lower pocket surface 68 are parallel and spaced to receive the extractor mechanism in a close-tolerance fit. As can be best seen in FIGS. 5 and 6, the upper pocket surface 66 and the lower pocket surface 68 are connected by a side surface 72 of the breech block 31. The contoured end 70 may include a recess 76 that accommodates a corresponding protrusion on the extractor mechanism to secure the extractor mechanism in the pocket 64.

Figure 7:
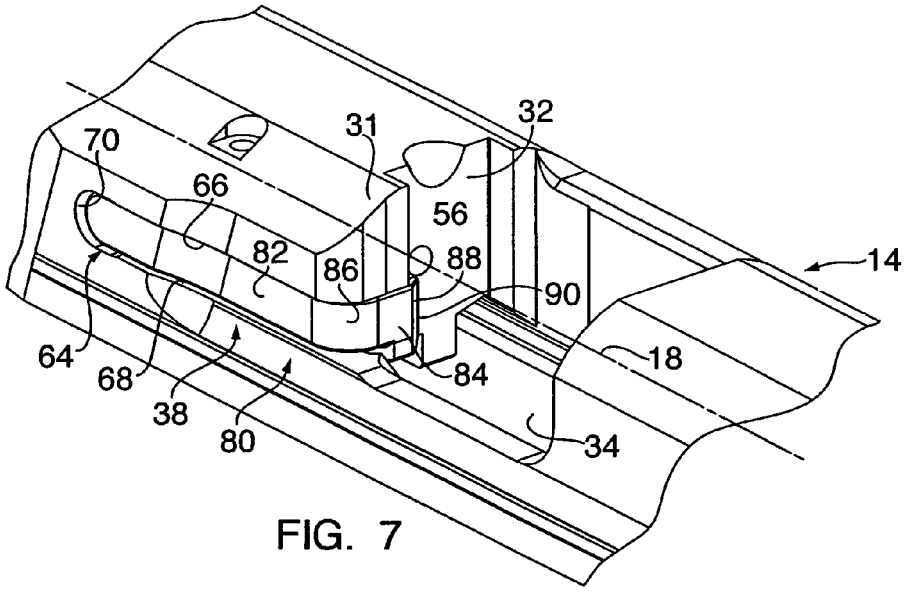
FIGS. 7 and 8 are simplified schematic perspective views of the extractor mechanism.
Figure 8:
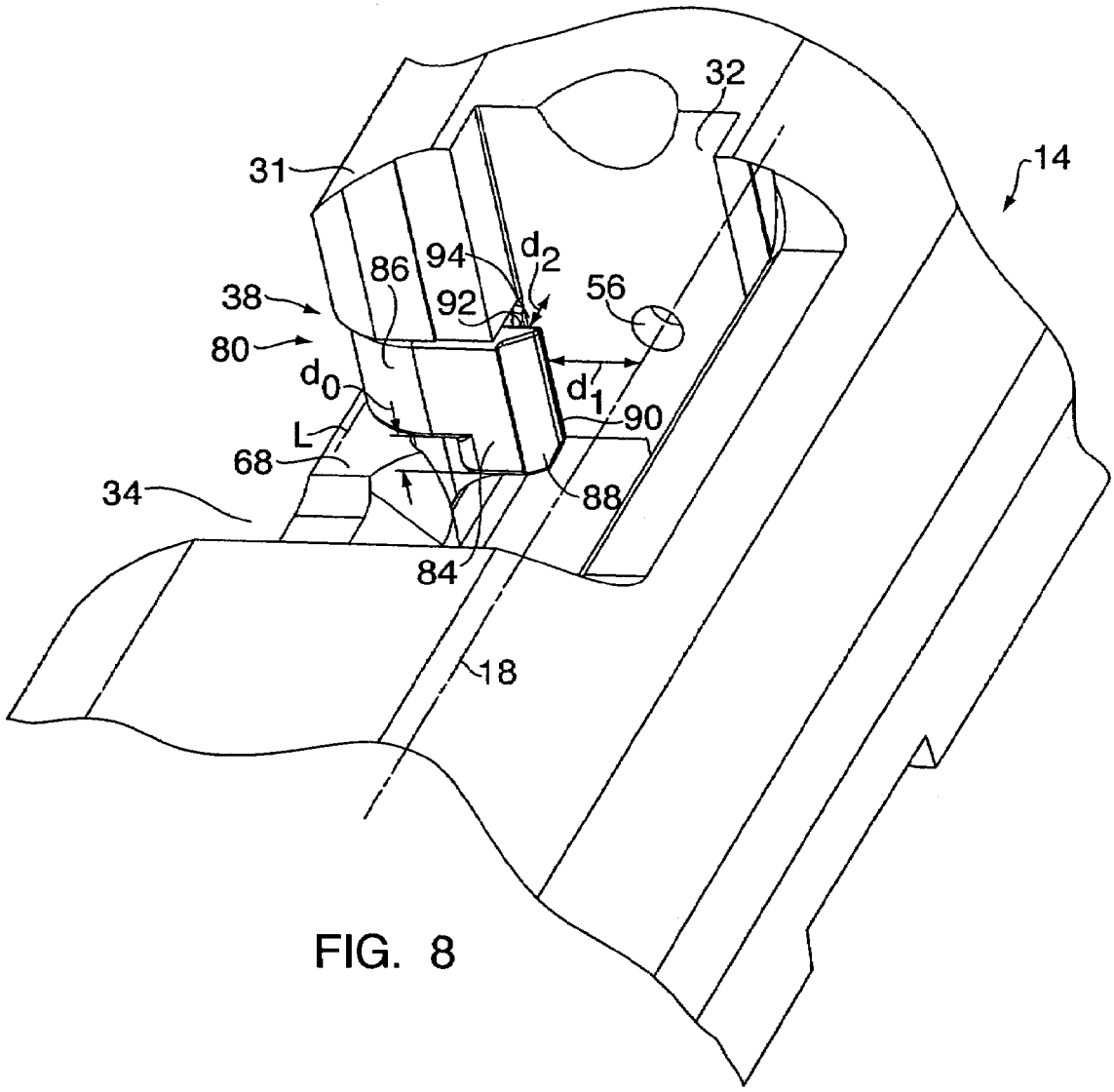

The extractor mechanism comprises an extractor arm 80, shown with reference to FIGS. 7 and 8, which is positioned in the pocket as shown. The extractor arm 80 comprises a body portion 82 and a hook portion 84. When positioned into the pocket, the body portion 82 extends substantially perpendicular to and along the longitudinal firing axis 18. The forward end of the body portion 82 extends around the corner defined by the breech face 32 and a side surface of the breech block 31 to terminate in the hook portion 84 that engages a rim of the casing of a cartridge. To provide strength to the extractor arm 80, the body portion 82 and the hook portion 84 are formed from a single piece of metal, and the transition portion from the body portion 82 (whose height lies in a plane substantially parallel to the firing axis) along the length of the slide 14 to the hook portion 84 (whose height lies in a plane substantially perpendicular to the firing axis) comprises a curved surface 86. Preferably this curved transition portion 86 forms a smooth curve from the plane of the body portion to the plane of the hook portion.

The hook portion 84 includes a hook 88 that depends from the forward end of the body portion 82 in a direction generally perpendicular to the longitudinal firing axis 18. The hook 88 is defined by at least two surfaces arranged to form an acute angle and that meet at an edge 90. The hook 88 is furthermore configured to extend in a downward direction a distance $d_0$ away from a major axis L of the body portion 82. The extension of the hook 88 in the downward direction facilitates the engagement of the hook 88 with the cartridge. In other words, the height of the hook portion 84 in a plane substantially perpendicular to the firing axis 18 is greater than the height of the body portion 82 in a plane parallel to the firing axis. The edge 90 is configured to facilitate movement of the hook portion 84 over the rim of a cartridge, points toward the longitudinal firing axis 18, and is spaced a distance $d_1$ therefrom. A hook face 92 is oriented substantially parallel to the breech face 32 and is spaced axially a distance $d_2$ therefrom to define a head space 94.

Figure 9:
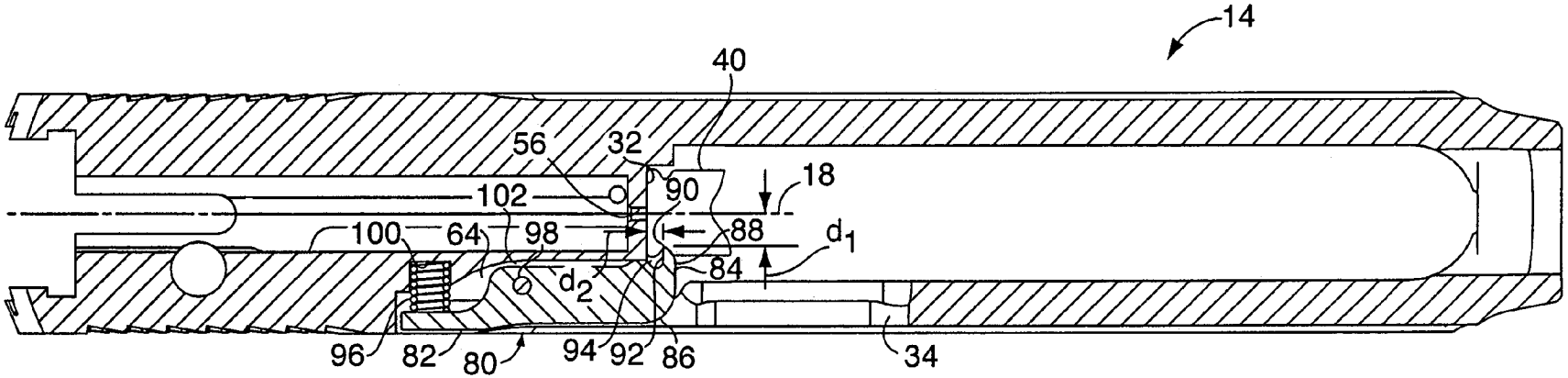
FIG. 9 is a simplified schematic plan view of the extractor mechanism housed in the slide.

Referring now to FIG. 9, the extractor arm 80 is preferably pivotally mounted in the pocket 64 by means of an extractor mount pin 98, and biased by means of an extractor spring 96. The extractor arm 80 and the extractor spring 96 are dimensioned according to standards known in the art that consider the type and caliber of firearm in which the components indicative of those described herein are used. An extractor spring bore 100 is appropriately sized to receive the extractor spring 96. The extractor mount pin 98 is press fitted vertically through the upper surface and the lower surface of the pocket 64 and fits loosely through the extractor arm 80 to allow pivotal movement of the extractor arm 80 in a plane substantially perpendicular to the breech face 32 and parallel to the longitudinal firing axis 18, thereby allowing the edge 90 of the hook 88 to engage the rim of the cartridge 40. An extractor pivot recess 102 is included to allow room for the extractor arm 80 to pivot within the pocket 64.

The distances $d_1$ and $d_2$ provide for the consistent, reliable operation of the handgun, including proper and consistent loading and extraction of cartridges 40.

In an embodiment of the present invention, a semiautomatic handgun comprises a frame, a slide reciprocatingly mounted on the frame, and a barrel mounted inside the slide. The slide comprises an elongated structure having a forward end for housing the barrel and a rearward end in which is housed a firing pin mechanism that cooperates with a trigger assembly and a fire control assembly mounted in the frame. The elongated structure of the slide includes an extractor mechanism having an arm. A body portion of the arm extends parallel to a longitudinal firing axis of the handgun, and a hook portion extends from a forward portion of the body portion to engage a cartridge rim. The hook portion extends downward from a major axis of the body portion to provide surface area that is sufficient for the engagement of the cartridge rim.

Although this invention has been shown and described with respect to the detailed embodiments thereof, it will be understood by those of skill in the art that various changes may be made and equivalents may be substituted for elements thereof without departing from the scope of the invention. Particularly, the present invention is not limited to a particular structure and arrangement of the slide components surrounding the extractor mechanism.

In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. An extractor mechanism for a firearm, the mechanism comprising:

a firearm slide having a pocket, said pocket extending in a longitudinal direction substantially parallel to a firing axis of a firearm, and having an opening proximate to a breech face of said slide; and an extractor arm having a body portion and a hook portion, said body portion disposed at least partially within said pocket and having a body height in a first plane substantially parallel to said firing axis, said hook portion extending at least partially out of said opening and having a hook height in a second plane substantially perpendicular to said firing axis, said hook height exceeding said body height, and said hook portion having a distal edge sized to engage a cartridge rim;

wherein the extractor arm is pivotally mounted to the slide in said pocket about a pivot pin connected to the slide, such that said hook portion is capable of being pivoted toward and away from said firing axis, and wherein the extractor mechanism further comprises a biasing device acting on the body portion of the extractor arm for biasing the hook portion toward the firing axis;

wherein said body portion and said hook portion are connected by a curved transition portion; and wherein the body portion, hook portion, and curved transition portion share a common upper surface defined by and lying coterminous with a third plane that is lateral to the extractor arm, and the body portion and the curved transition portion share a common lower surface defined by and lying coterminous with a fourth plane that is lateral to the extractor arm, said third and fourth planes being parallel to one another, with a lower bound of the hook portion extending below the fourth plane;

whereby the reliability with which a cartridge is engaged and extracted by said extractor mechanism is enhanced.

2. The extractor mechanism of claim 1 wherein:

the biasing device is a spring that acts against the body portion of the extractor arm solely in a direction of pivotal movement of the extractor arm, said spring being the only biasing device acting upon the extractor arm.

3. An extractor mechanism for a firearm, the mechanism comprising:

a firearm slide having a pocket, said pocket extending in a longitudinal direction substantially parallel to a firing axis of a firearm, and having an opening proximate to a breech face of said slide; and an extractor arm having a body portion and a hook portion, said body portion being disposed at least partially within said pocket, said body portion and said hook portion being connected by a curved transition portion, and said hook portion extending at least partially out of said opening and having a distal edge sized to engage a cartridge rim;

wherein the extractor arm is pivotally mounted to the slide in said pocket about a pivot pin connected to the slide, such that said hook portion is capable of being pivoted toward and away from said firing axis, and wherein the extractor mechanism further comprises a biasing device acting on the body portion of the extractor arm for biasing the hook portion toward the firing axis; and wherein the body portion, hook portion, and curved transition portion share a common upper surface defined by and lying coterminous with a first plane that is lateral to the extractor arm, and the body portion and the curved transition portion share a common lower surface defined by and lying coterminous with a second plane that is lateral to the extractor arm, said first and second planes being parallel to one another, with a lower bound of the hook portion extending below the second plane;

whereby the reliability with which a cartridge is engaged and extracted by said extractor mechanism is enhanced.

4. The extractor mechanism of claim 3 wherein:

the biasing device is a spring that acts against the body portion of the extractor arm solely in a direction of pivotal movement of the extractor arm, said spring being the only biasing device acting upon the extractor arm.

5. An extractor arm adapted for use with a semi-automatic firearm having a slide, said extractor arm comprising:

a body portion having a body height in a first plane and adapted for pivotal mounting within a recess of a firearm slide; and a hook portion connected to said body portion and having a hook height in a second plane and a distal edge sized to engage a cartridge rim, said second plane being substantially perpendicular to said first plane, and said hook height exceeding said body height, wherein said body portion and said hook portion are connected by a curved transition portion;

wherein the body portion, hook portion, and curved transition portion share a common upper surface defined by and lying coterminous with a third plane that is lateral to the extractor arm, and the body portion and the curved transition portion share a common lower surface defined by and lying coterminous with a fourth plane that is lateral to the extractor arm, said third and fourth planes being parallel to one another, with a lower bound of the hook portion extending below the fourth plane;

whereby the reliability with which a cartridge is engaged and extracted by an extractor mechanism utilizing said extractor arm is enhanced.

6. The extractor arm of claim 5 wherein a first and second surface meet at said distal edge, said first surface being arranged in a plane substantially parallel to said second plane, said second surface being arranged in a plane that diverges from said second plane at an acute angle, and said first surface being located on an interior side of an angle between said body portion and said hook portion.

7. An extractor mechanism for a firearm, the mechanism comprising:

a firearm slide having a pocket, said pocket extending in a longitudinal direction substantially parallel to a firing access of a firearm, and having an opening proximate to a breech face of said slide; and an extractor arm having an elongate body portion and a hook portion, said body portion being disposed at least partially within said pocket, said body portion and said hook portion being connected by a curved transition portion, and said hook portion extending at least partially out of said opening and having a distal edge sized to engage a cartridge rim;

wherein the body portion of the extractor arm is pivotally mounted to the slide in said pocket about a pivot pin connected to the slide, such that said hook portion is capable of being pivoted toward and away from said firing axis, said body portion having a first distal end and a second distal end and being pivotally connected about the pivot pin at a point between the first and second distal ends;

wherein the extractor mechanism further comprises a spring acting on the first distal end of the body portion of the extractor arm for biasing the hook portion toward the firing axis, said hook portion being connected to the second distal end of the body portion, and said spring acting against the body portion of the extractor arm solely in alignment with the extractor arm's direction of pivotal motion about the pivot pin, and said spring being the only biasing device acting upon the extractor arm; and wherein the body portion, hook portion, and curved transition portion share a common upper surface defined by and lying coterminous with a first plane that is lateral to the extractor arm, and the body portion and the curved transition portion share a common lower surface defined by and lying coterminous with a second plane that is lateral to the extractor arm, said first and second planes being parallel to one another and perpendicular to a pivot axis of the pivot pin, with a lower bound of the hook portion extending below the second plane.

* * * * *